US010172467B1

(12) United States Patent
Shih

(10) Patent No.: US 10,172,467 B1
(45) Date of Patent: Jan. 8, 2019

(54) PIVOTABLE TOP BOARD DEVICE FOR A CHAIR

(71) Applicant: Deng-Tai Shih, Tainan (TW)

(72) Inventor: Deng-Tai Shih, Tainan (TW)

(73) Assignee: Gauss Furniture Co., Ltd., Tainan (TW)

( * ) Notice: Subject to any disclaimer, the term of this patent is extended or adjusted under 35 U.S.C. 154(b) by 0 days.

(21) Appl. No.: 15/801,555

(22) Filed: Nov. 2, 2017

(51) Int. Cl.
*A47C 7/70* (2006.01)

(52) U.S. Cl.
CPC ..... *A47C 7/70* (2013.01)

(58) Field of Classification Search
CPC ..... A47C 7/70; A47C 7/68; A47C 7/705
USPC ..... 297/162, 160, 161
See application file for complete search history.

(56) References Cited

U.S. PATENT DOCUMENTS 5,087,096 A * 2/1992 Yamazaki ..... A47C 7/70 297/145
5,845,964 A * 12/1998 Phoon ..... A47C 7/70 297/162
7,695,061 B2 * 4/2010 Olarte ..... A47C 7/70 297/162
2008/0197678 A1 * 8/2008 Olarte ..... A47C 7/70 297/162
2014/0312669 A1 * 10/2014 Zheng ..... B64D 11/00 297/354.1

* cited by examiner

*Primary Examiner* — Mark R Wendell
(74) *Attorney, Agent, or Firm* — Alan D. Kamrath; Kamrath IP Lawfirm, P.A.

(57) ABSTRACT

A pivotable top board device for a chair includes an armrest having a coupling face with a first positioning hole. An axle block includes a first coupling face and a second coupling face. The first coupling face of the axle block is pivotably coupled to the coupling face of the armrest. The axle block further includes a through-hole extending from the first coupling face through the second coupling face. An operation rod longer than the through-hole is received in the through-hole and includes a first positioning end for disengagably engagement with the first positioning hole of the armrest and a second positioning end. The second coupling face of the axle block is pivotably coupled to a coupling face of a coupling board fixed to a top board. The coupling face of the coupling board includes a second positioning hole releasably receiving the second positioning end of the operation rod.

4 Claims, 11 Drawing Sheets

A - A

B - B

C - C

PIVOTABLE TOP BOARD DEVICE FOR A CHAIR

BACKGROUND OF THE INVENTION

The present invention relates to a pivotable top board device for a chair and, more particularly, to a pivotable top board device for a chair for increasing stability during unfolding and folding operations.

Chairs used in conference rooms, classrooms, etc. generally include a top board that can be unfolded for easy writing for a user or can be folded when the user leaves the chair.

FIGS. 8 and 9 show a conventional chair with a pivotable top board device including an armrest 1', an axle block 2', a coupling board 3', and a top board 4'. A receiving space 6' is defined between the armrest 1' and a body 5' of the chair. The armrest 1' includes a pivotal hole 11'. The axle block 2' includes a first coupling face 21' and a second coupling face 22' at an angel of 45° to the first coupling face 21'. Each of the first and second coupling faces 21' and 22' has a stub 211', 221'. The stub 211' extends into the pivotal hole 11' to be pivotably connected to the armrest 1'. A positioning groove 222' is defined in the second coupling face 22'. The coupling board 3' includes a side having a coupling face 31' at an angel of 45° to a top face of the coupling board 3'. A pivotal hole 311' is defined in the coupling face 31' and pivotably receives the stub 221' of the axle block 2'. A protrusion 312' is provided on the coupling face 31' in a location corresponding to the positioning groove 222'. The top board 4' is fixed to the coupling board 3'. When not in use, the top board 4' can be pivoted into the receiving space 6'. In use, the top board 4' is lifted upward and pivots the axle block 2' through an angle of 90° (see FIG. 10). Then, the top board 4' is pivoted relative to the axle block 2' to an extended position shown in FIG. 8, with the protrusion 312' abutting against an edge of the positioning groove 222'.

However, stable operation of the coupling board 3' and the axle block 2' cannot be supported by the pivotal arrangement therebetween. For example, as shown in FIG. 11, the axle block 2' is apt to pivot while the top board 4' is being pivoted to the folded position, leading to deviation of the top board 4' from the vertical direction. Thus, the angular position of the top board 4' must be readjusted for the folding operation, which not only is inconvenient to folding but causes friction and wear between an edge of the top board 4' and a surface of the armrest 1'.

BRIEF SUMMARY OF THE INVENTION

An objective of the present invention is to provide a pivotable top board device for a chair for increasing stability during unfolding and folding operations.

A pivotable top board device for a chair according to the present invention includes an armrest having a coupling face with a first positioning hole. An axle block includes a first coupling face and a second coupling face at an angel of 45° to the first coupling face. The first coupling face of the axle block is pivotably coupled to the coupling face of the armrest. The axle block further includes a through-hole extending from the first coupling face through the second coupling face and having a longitudinal axis. A positioning device is received in the through-hole and includes an operation rod and an elastic element providing elasticity for moving the operation rod. The operation rod is received in the through-hole and includes a first positioning end and a second positioning end. The operation rod has a length along the longitudinal axis larger than a length of the through-hole along the longitudinal axis. A coupling board includes a top face and a coupling face at an angle of 45° to the top face. The second coupling face of the axle block is pivotably coupled to the coupling face of the coupling board. The coupling face of the coupling board includes a second positioning hole. A top board is fixed to the coupling board. The top board is pivotable to pivot the axle block, thereby proceeding with unfolding operation and folding operation of the top board.

The operation rod is movable in the through-hole along the longitudinal axis under action of the elastic element to move between a first position in which the first positioning end protrudes outside of the first coupling face to engage with the first positioning hole of the armrest and a second position in which the second positioning end protrudes outside of the second coupling face to engage with the second positioning hole of the coupling board.

In an example, the coupling face of the armrest includes a pivotal hole and two abutting portions respectively corresponding to the unfolding operation and the folding operation. The axle block further includes a first stub provided on the first coupling face and a second stub provided on the second coupling face. The first stub is received in the pivotal hole of the armrest and is secured by a fastener. The second coupling face includes an arcuate positioning groove. The axle block further includes two abutting sides for respectively abutting against the two abutting portions respectively corresponding to the unfolding operation and the folding operation. The coupling face of the coupling board further includes a pivotal hole that receives the second stub of the axle block and that is secured by another fastener. The coupling face of coupling board further includes a protrusion slideably received in the arcuate positioning groove.

In an example, the axle block includes a first shoulder provided on an inner periphery of the through-hole. The operation rod includes a second shoulder. The elastic element is mounted around the operation rod and includes a first end abutting the first shoulder and a second end abutting the second shoulder.

In an example, the axle block further includes a guiding groove defined in the inner periphery of the through-hole. The operation rod includes a flange slideably received in the guiding groove. The second positioning end of the operation rod includes an inclined guiding side.

The present invention will become clearer in light of the following detailed description of illustrative embodiments of this invention described in connection with the drawings.

DETAILED DESCRIPTION OF THE INVENTION

Figure 1:
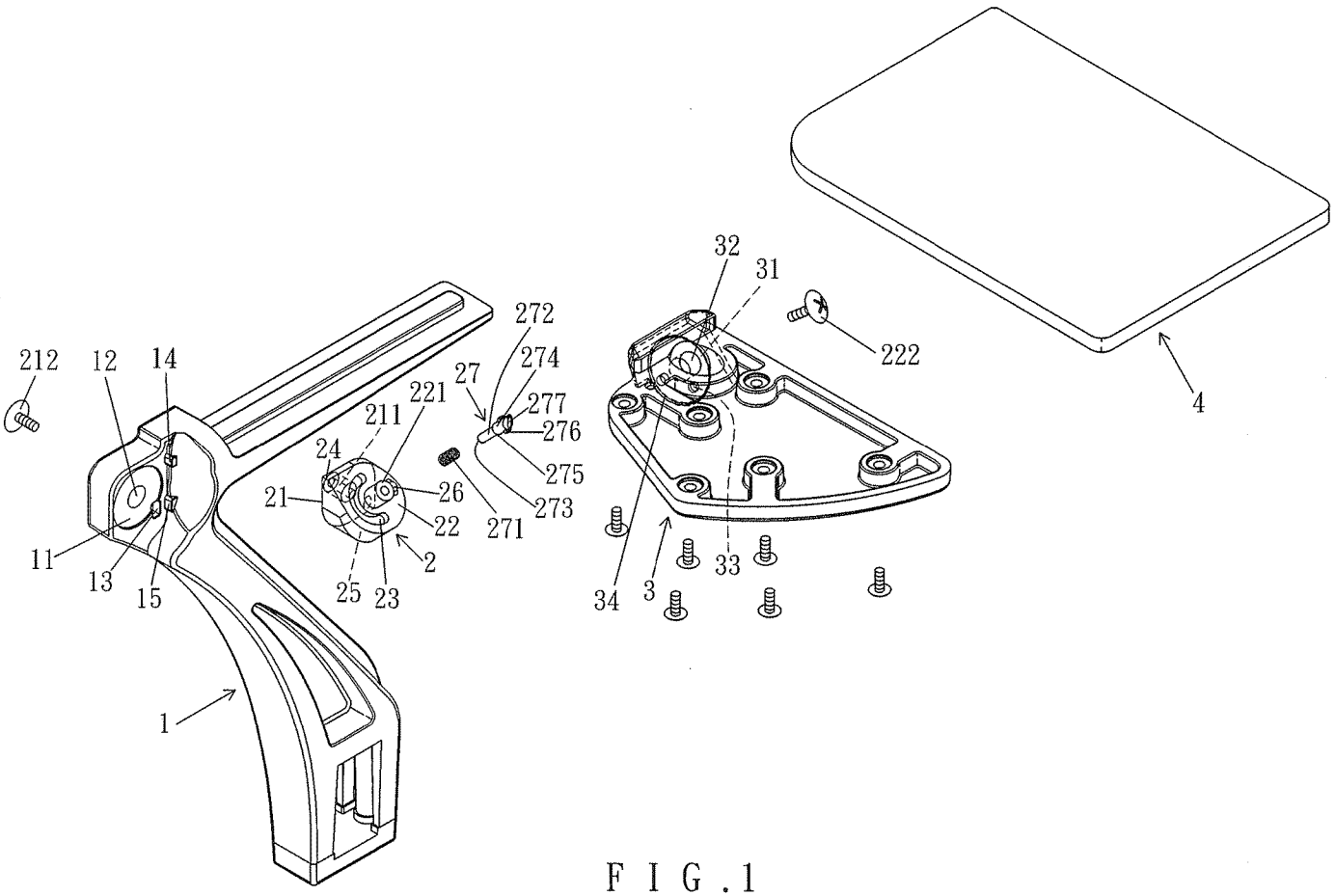
FIG. 1 is an exploded, perspective view of a pivotable top board device for a chair of an embodiment according to the present invention.
Figure 2:
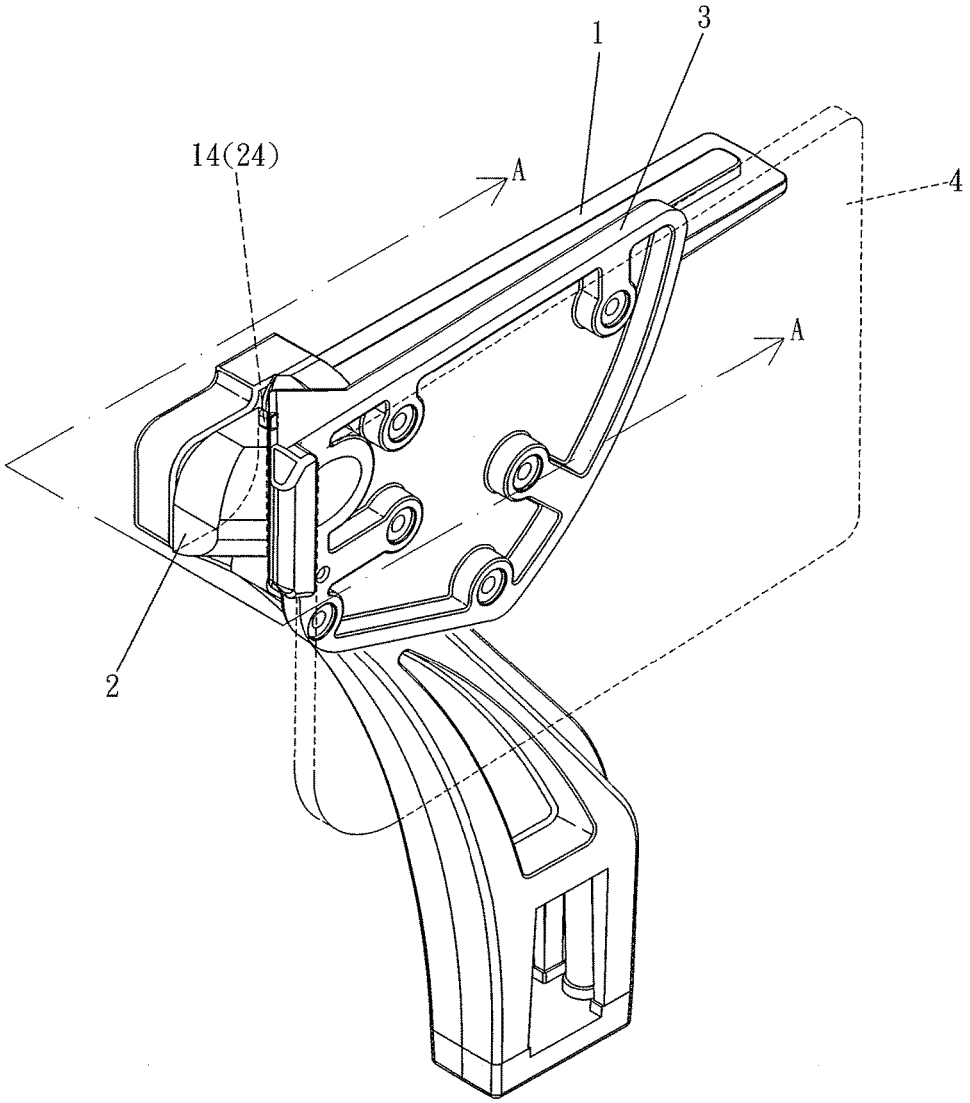
FIG. 2 is a perspective view of the pivotable top board device of FIG. 1, with a top board of the pivotable top board device in a lower, vertical position.
Figure 3:
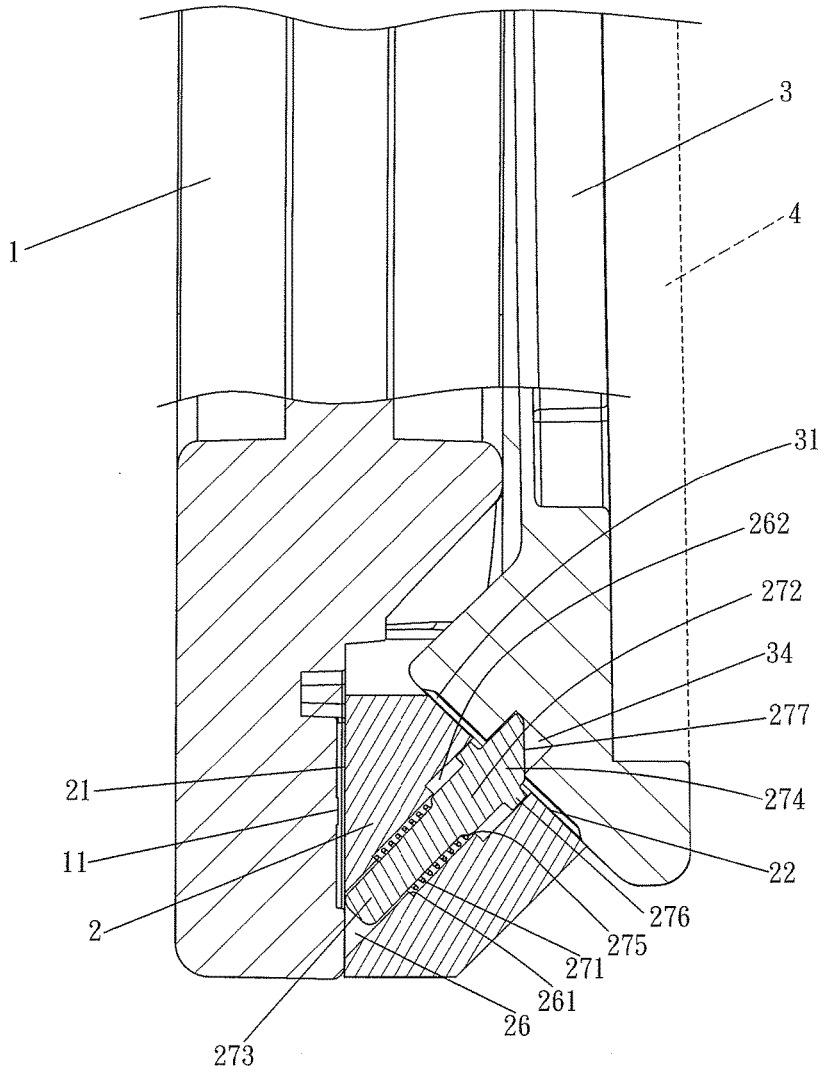
FIG. 3 is a cross sectional view taken along section line A-A of FIG. 2.

With reference to FIGS. 1-3, a pivotable top board device for a chair of an embodiment according to the present invention includes an armrest 1, an axle block 2, a coupling board 3, and a top board 4. The armrest 1 includes a coupling face 11 having a pivotal hole 12 and a first positioning hole 13 spaced from the pivotal hole 12 in a radial direction. The coupling face 11 of the armrest 1 further includes two abutting portions 14 and 15. The first positioning hole 13 is located between the pivotal hole 12 of the armrest 1 and the two abutting portions 14 and 15 respectively corresponding to unfolding operation and folding operation of the top board 4.

The axle block 2 includes a first coupling face 21 and a second coupling face 22 at an angel of 45° to the first coupling face 21. The axle block 2 further includes a first stub 211 provided on the first coupling face 21 and a second stub 221 provided on the second coupling face 22. The first stub 211 is received in the pivotal hole 12 of the armrest 1 and is secured by a fastener 212. Thus, the first coupling face 21 of the axle block 2 is pivotably coupled to the coupling face 11 of the armrest 1. The second coupling face 22 includes an arcuate positioning groove 23. The axle block 2 further includes two abutting sides 24 and 25 for respectively abutting against the two abutting portions 14 and 15 respectively corresponding to the unfolding operation and the folding operation.

The axle block 2 further includes a through-hole 26 extending from the first coupling face 21 through the second coupling face 22 and having a longitudinal axis. A positioning device 27 is received in the through-hole 26 and includes an operation rod 272 and an elastic element 271 providing elasticity for moving the operation rod 27. The axle block 2 includes a first shoulder 261 provided on an inner periphery of the through-hole 26. Furthermore, the axle block 2 includes a guiding groove 262 defined in in an end of the inner periphery of the through-hole 26.

The operation rod 272 is received in the through-hole 26 and includes a first positioning end 273 and a second positioning end 274. The operation rod 272 has a length along the longitudinal axis of the through-hole 26 larger than a length of the through-hole 26 along the longitudinal axis. The operation rod 272 includes a second shoulder 275. The elastic element 271 is received in the through-hole 26, is mounted around the operation rod 272, and includes a first end abutting the first shoulder 26 and a second end abutting the second shoulder 275. The operation rod 272 further includes a flange 276 slideably received in the guiding groove 262. Thus, the operation rod 272 is slideable along the longitudinal axis under action of the elastic element 271 but is not rotatable about the longitudinal axis. Specifically, the operation rod 272 is movable in the through-hole 26 along the longitudinal axis under action of the elastic element 271 to move between a first position in which the first positioning end 273 protrudes outside of the first coupling face 21 to engage with the first positioning hole 13 of the armrest 1 and a second position in which the second positioning end 274 protrudes outside of the second coupling face 22 to engage with the second positioning hole 34 of the coupling board 3. The second positioning end 274 of the operation rod 272 includes an inclined guiding side 277.

The coupling board 3 includes a top face and a coupling face 31 at an angle of 45° to the top face. The coupling face 31 of the coupling board 3 includes a pivotal hole 32 that receives the second stub 221 of the axle block 2 and that is secured by another fastener 222. Thus, the second coupling face 22 of the axle block 2 is pivotably coupled to the coupling face 31 of the coupling board 3. The coupling face 31 of coupling board 3 further includes a protrusion 33 slideably received in the arcuate positioning groove 23. The protrusion 33 of the coupling board 3 slides along the arcuate positioning groove 23 when the top board 4 moves between the folded position and the unfolded position. The coupling face 31 of the coupling board 3 includes a second positioning hole 34. The top board 4 is fixed to the coupling board 3.

With reference to FIGS. 2 and 3, when the top board 4 is in the folded position, the top board 4 is at a side of the armrest 1, and the second positioning end 274 of the operation rod 272 is biased by the elastic element 271 into the second positioning hole 34 of the coupling board 3. In this case, the first positioning end 273 of the operation rod 272 is not aligned with the first positioning hole 13 of the armrest 1 and is received in the through-hole 26. Thus, the coupling board 3 and the axle block 2 are coupled and jointly movable with each other. In this state, the protrusion 33 of the coupling board 3 is engaged in the arcuate positioning groove 23.

Figure 4:
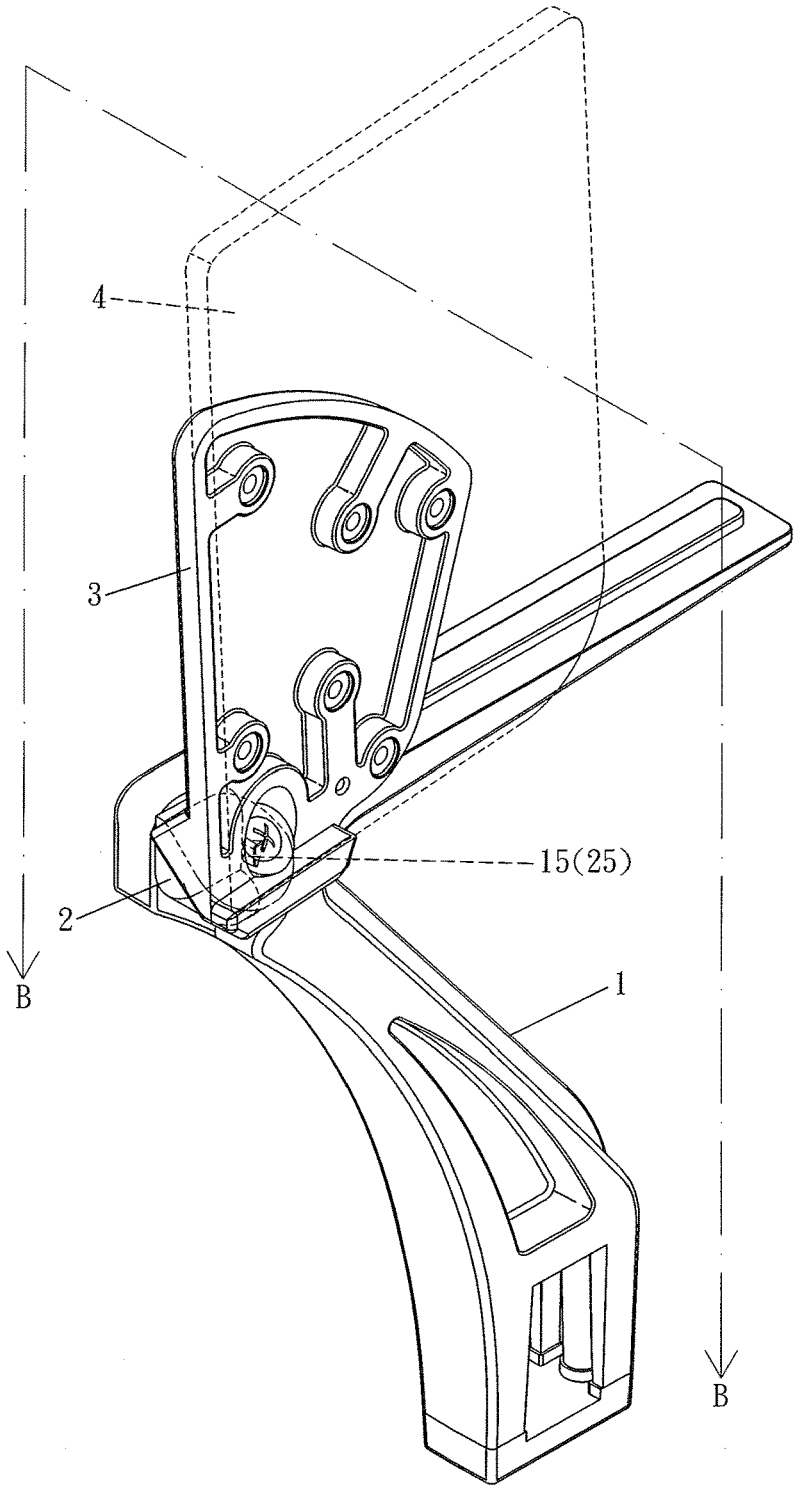
FIG. 4 is a perspective view of the pivotable top board device of FIG. 2, with the top board in an upper, vertical position.
Figure 5:
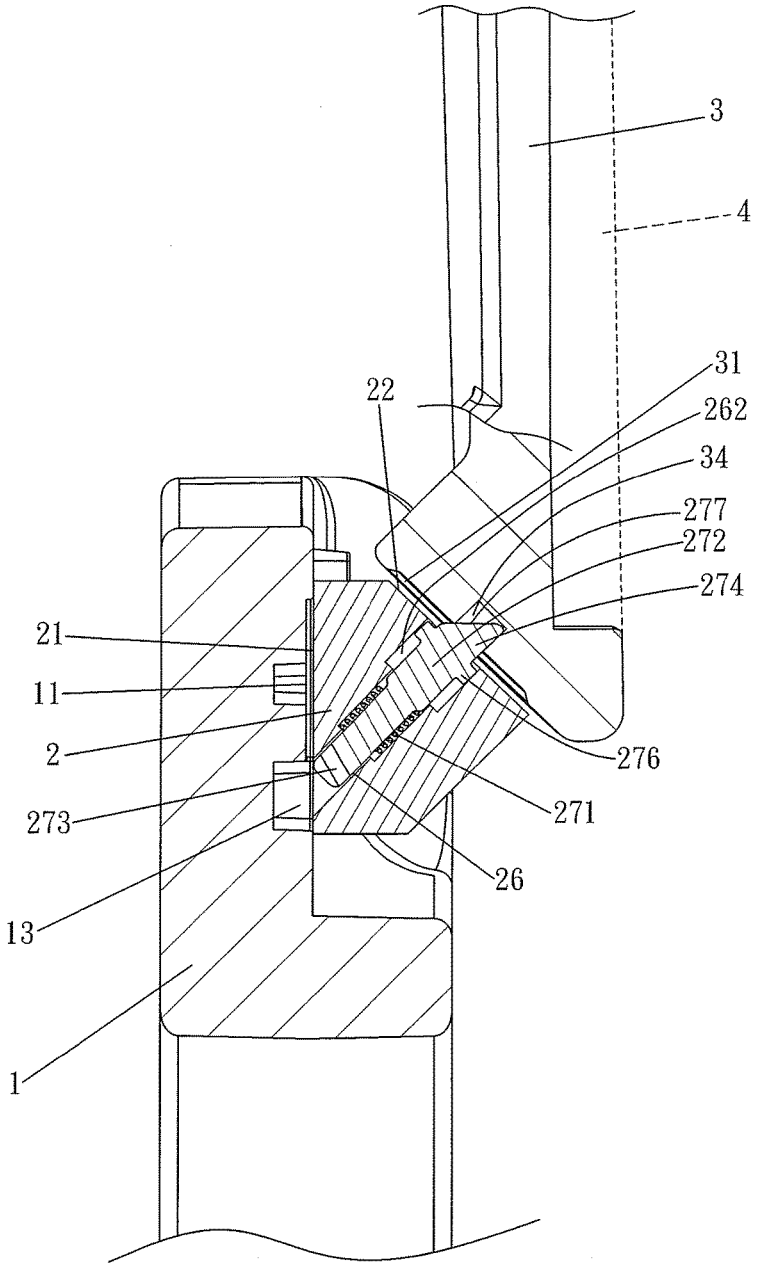
FIG. 5 is a cross sectional view taken along section line B-B of FIG. 4.

With reference to FIGS. 4 and 5, when it is desired to unfold, the top board 4 is pivoted 180° relative to the armrest 1 and pivots the axle block 2. Furthermore, the abutting side 25 of the axle block 2 abuts against the abutting portion 15 of the armrest 1 to restrain rotation of the axle block 2. At this time, the first positioning end 273 of the operation rod 272 is aligned with the first positioning hole 13 of the armrest 1.

Figure 6:
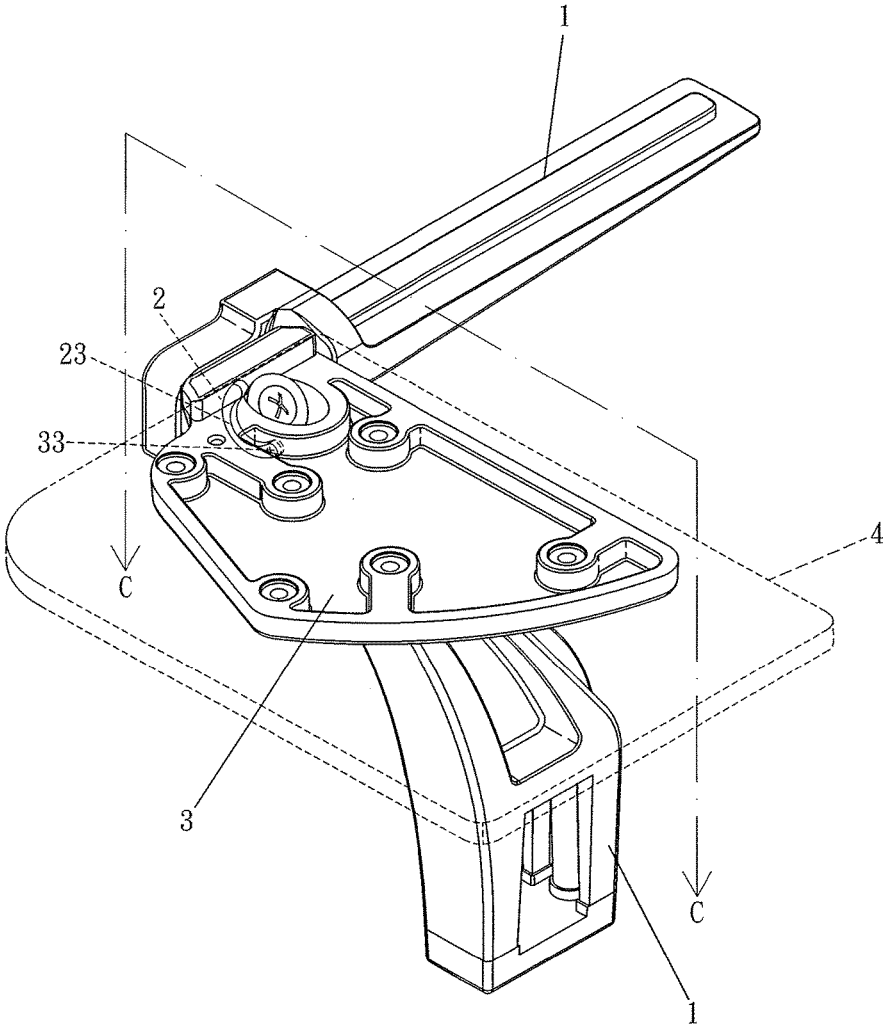
FIG. 6 is a perspective view of the pivotable top board device of FIG. 1, with the top board in a horizontal position.
Figure 7:
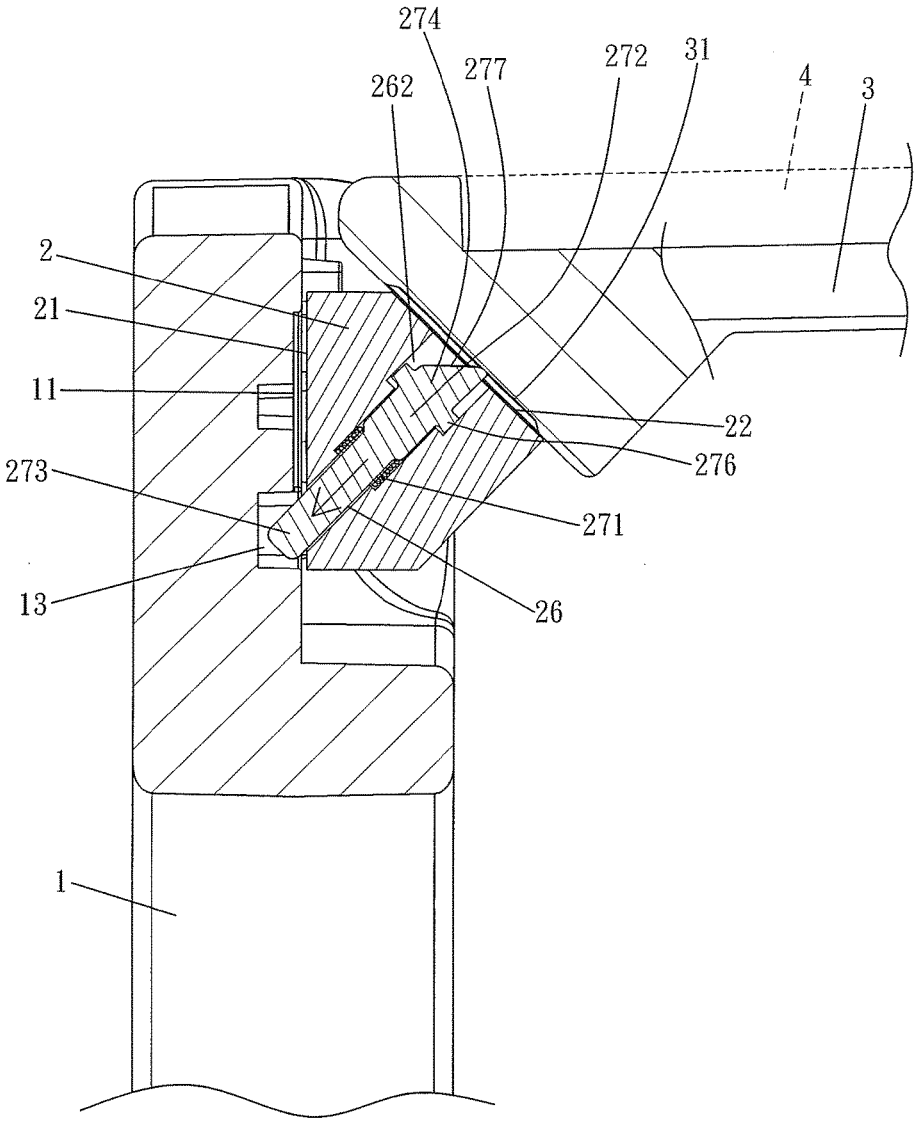
FIG. 7 is a cross sectional view taken along section line C-C of FIG. 6.
Figure 8:
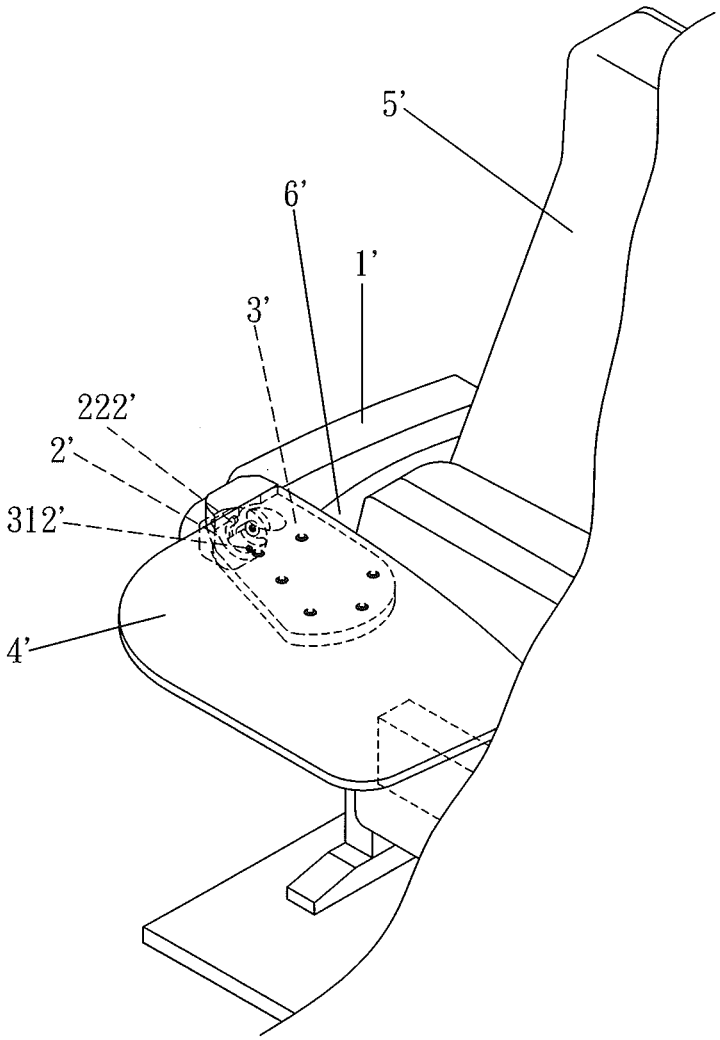
PRIOR ART F I G . 8
FIG. 8 is a partial, perspective view of a conventional chair with a pivotable top board, with the top board in an unfolded position.
Figure 9:
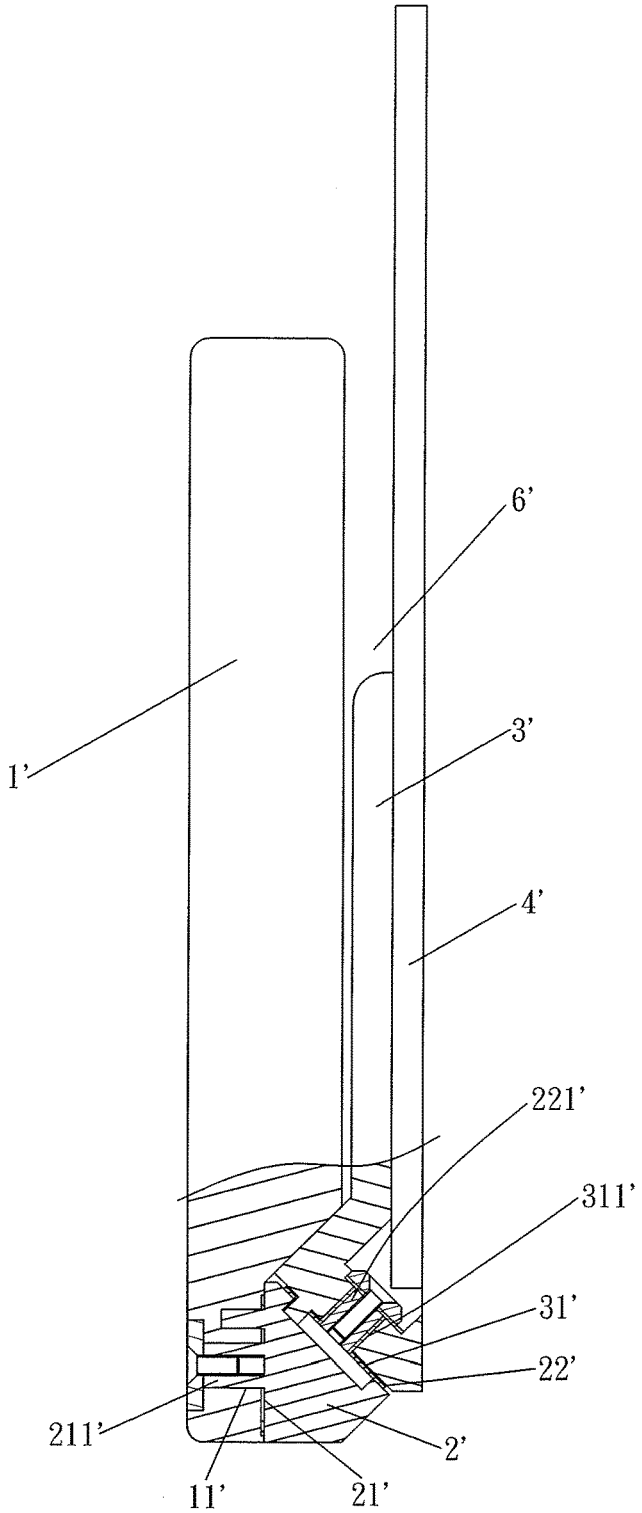
PRIOR ART F I G . 9
FIG. 9 is a partly-cross sectioned side view of the conventional chair of FIG. 8, with the top board in a folded position.
Figure 10:
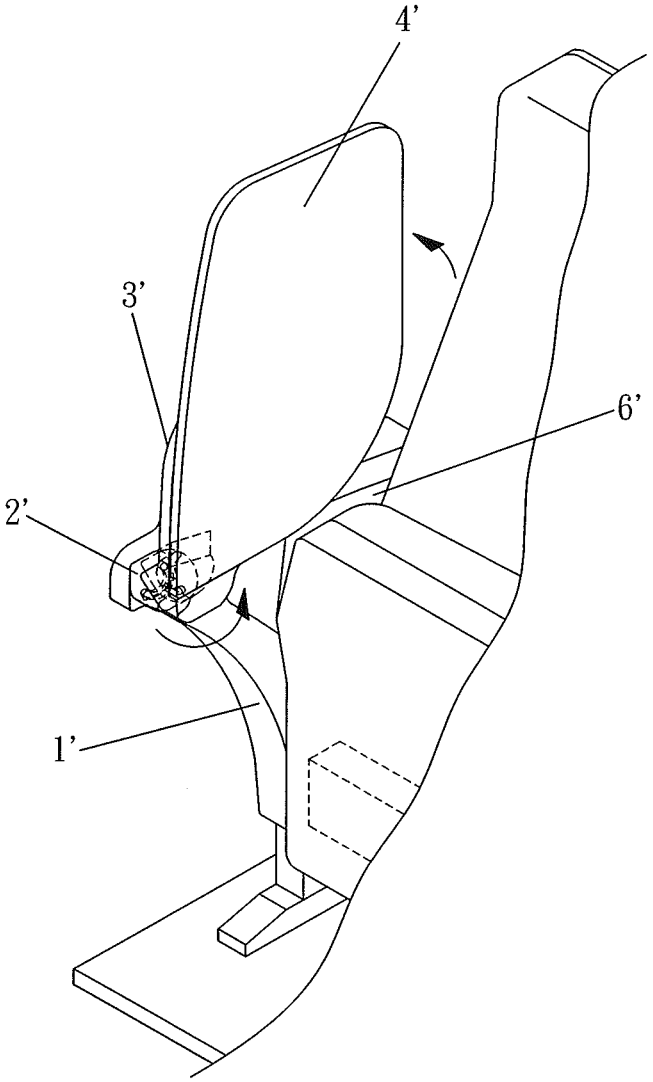
PRIOR ART F I G . 10
FIG. 10 is a partial, perspective view of the conventional chair of FIG. 8, illustrating unfolding operation of the top board.
Figure 11:
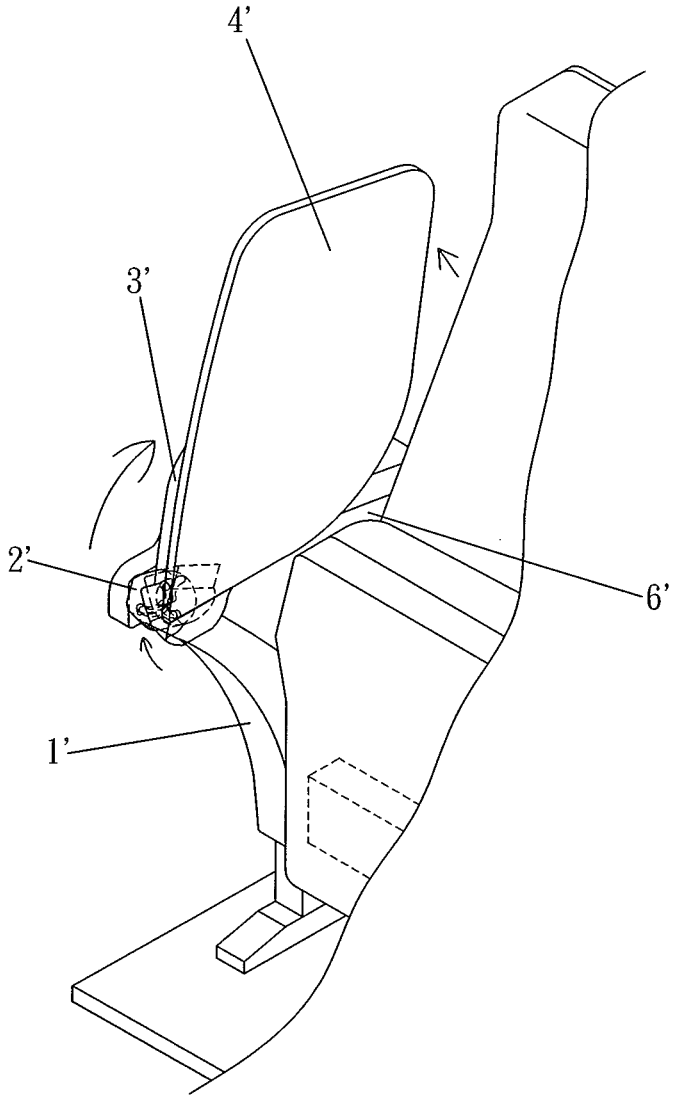
PRIOR ART F I G . 11
FIG. 11 is a partial, perspective view illustrating folding operation of the top board of the conventional chair of FIG. 8.

With reference to FIGS. 6 and 7, when the top board 4 is flipped relative to the axle block 2 to a horizontal position, the second positioning hole 34 of the coupling board 3 disengages from the second positioning end 274 of the operation rod 272. Furthermore, an edge of the second positioning hole 34 and the coupling face 31 of the coupling board 3 presses against the inclined guiding face 277 of the second positioning end 274 to move the operation rod 272 along the longitudinal axis, thereby moving the second positioning end 274 of the operation rod 272 into the through-hole 26. The first positioning end 273 is moved into the first positioning hole 13 of the armrest 1, and the elastic element 271 is compressed. Thus, the axle block 2 is securely engaged with the armrest 1 and, thus, will not pivot when the top board 4 is flipped. Furthermore, the protrusion 33 of the coupling board 3 moves relative to the arcuate positioning groove 23 until the protrusion 33 abuts an end of the arcuate positioning groove 23 to retain the top board 4 in the unfolded position. The positioning device 27 cooperates with the coupling board 3 and the armrest 1 to provide a more stable operation.

When it is desired to fold the top board 4 again, the top board 4 is flipped reversely from the position shown in FIG.

6 to the position shown in FIG. 4. Since the axle block 2 still engages with the armrest 1 and will not pivot together with the top board 4, the top board 4 can be flipped in a direction to the vertical direction at a side of the armrest. Then, the top board 4 is pivoted in a reverse direction to the position shown in FIG. 2. During the folding movement of the top board 4, the top board 4 is avoided from pressing against the armrest 1 to thereby avoid rubbing between the top board 4 and the surface of the armrest 1. Furthermore, since the second positioning hole 34 of the coupling board 3 is pivoted to a position aligned with the second positioning end 274 of the operation rod 272, the elastic element 271 elastically urges the second positioning end 274 of the operation rod 272 into the second positioning hole 34 of the coupling board 34, such that the coupling board 3 and the axle block 2 can move jointly again. Accordingly, the pivotable top board device according to the present invention provides improved stability for folding and unfolding operations.

Although specific embodiments have been illustrated and described, numerous modifications and variations are still possible without departing from the scope of the invention. The scope of the invention is limited by the accompanying claims.

The invention claimed is:

1. A pivotable top board device for a chair, comprising:

an armrest including a coupling face having a first positioning hole;

an axle block including a first coupling face and a second coupling face at an angle of 45° to the first coupling face, wherein the first coupling face of the axle block is pivotably coupled to the coupling face of the armrest, wherein the axle block further includes a through-hole extending from the first coupling face through the second coupling face and having a longitudinal axis, wherein a positioning device is received in the through-hole and includes an operation rod and an elastic element providing elasticity for moving the operation rod, wherein the operation rod is received in the through-hole and includes a first positioning end and a second positioning end, wherein the operation rod has a length along the longitudinal axis larger than a length of the through-hole along the longitudinal axis;

a coupling board including a top face and a coupling face at an angle of 45° to the top face, wherein the second coupling face of the axle block is pivotably connected to the coupling face of the coupling board, wherein the coupling face of the coupling board includes a second positioning hole;

a top board fixed to the coupling board, wherein the top board is pivotable to pivot the axle block, thereby proceeding with unfolding operation and folding operation of the top board;

wherein the operation rod is movable in the through-hole along the longitudinal axis under action of the elastic element to move between a first position in which the first positioning end protrudes outside of the first coupling face to engage with the first positioning hole of the armrest and a second position in which the second positioning end protrudes outside of the second coupling face to engage with the second positioning hole of the coupling board.

2. The pivotable top board device for the chair as claimed in claim 1, wherein the coupling face of the armrest includes a pivotal hole and two abutting portions respectively corresponding to the unfolding operation and the folding operation, wherein the axle block further includes a first stub provided on the first coupling face and a second stub provided on the second coupling face, wherein the first stub is received in the pivotal hole of the armrest and is secured by a fastener, wherein the second coupling face includes an arcuate positioning groove, wherein the axle block further includes two abutting sides for respectively abutting against the two abutting portions respectively corresponding to the unfolding operation and the folding operation, wherein the coupling face of the coupling board further includes a pivotal hole that receives the second stub of the axle block and that is secured by another fastener, wherein the coupling face of coupling board further includes a protrusion slideably received in the arcuate positioning groove.

3. The pivotable top board device for the chair as claimed in claim 1, wherein the axle block includes a first shoulder provided on an inner periphery of the through-hole, wherein the operation rod includes a second shoulder, wherein the elastic element is mounted around the operation rod and includes a first end abutting the first shoulder and a second end abutting the second shoulder.

4. The pivotable top board device for the chair as claimed in claim 3, wherein the axle block further includes a guiding groove defined in the inner periphery of the through-hole, wherein the operation rod includes a flange slideably received in the guiding groove, and wherein the second positioning end of the operation rod includes an inclined guiding side.

* * * * *